US005755345A

United States Patent [19]

Valyi

[11] Patent Number: 5,755,345

[45] Date of Patent: May 26, 1998

[54] CLOSURE FOR BLOW MOLDED ARTICLES INCLUDING A SEPARATELY FORMED INSERT

[76] Inventor: Emery I. Valyi, 102 Moseman Ave., Katonah, N.Y. 10536

[21] Appl. No.: 605,492

[22] Filed: Feb. 26, 1996

[51] Int. Cl.[6] ..... B65D 41/00

[52] U.S. Cl. ..... 215/250; 138/89; 138/96 T; 215/276; 215/44; 220/288; 220/255; 220/319; 285/419; 285/921

[58] Field of Search ..... 29/463; 215/44, 215/40, 250, 252, 274, 276; 220/640, 319, 288, 255; 285/419, 373, 921; 138/96 T, 167, 89

[56] References Cited

U.S. PATENT DOCUMENTS

| | | | |
|---|---|---|---|
| 2,052,958 | 9/1936 | Webb | 285/419 X |
| 3,966,082 | 6/1976 | Hopkins | 215/274 X |
| 4,218,814 | 8/1980 | Hodapp | 138/167 X |
| 4,233,469 | 11/1980 | Steppe | 138/96 T X |
| 4,588,098 | 5/1986 | Udzy | 215/250 X |
| 4,614,016 | 9/1986 | Laing et al. | 29/463 X |
| 4,646,926 | 3/1987 | Agbay et al. | 215/250 X |
| 4,865,890 | 9/1989 | Erlichman | 285/419 X |
| 5,015,013 | 5/1991 | Nadin | 285/419 X |
| 5,358,283 | 10/1994 | Silva | 285/375 X |

FOREIGN PATENT DOCUMENTS

| | | | |
|---|---|---|---|
| 870676 | 3/1942 | France | 215/334 |
| 164288 | 8/1958 | Sweden | 215/334 |
| 103601 | 2/1917 | United Kingdom | 215/274 |
| 430096 | 6/1935 | United Kingdom | 215/334 |
| 18205 | 11/1989 | United Kingdom | 215/334 |

*Primary Examiner*—Allan N. Shoap
*Assistant Examiner*—Robin A. Hylton
*Attorney, Agent, or Firm*—Bachman & LaPointe, P.C.

[57] ABSTRACT

A closure which comprises a body portion having an open end, a closed end, an inner wall and an outer circumferential wall and an insert. The insert is for engaging a container, wherein the insert is formed separately from the body portion and includes a manner for attachment to the body portion. The insert is attached to the body portion adjacent the inner wall via the manner for attachment.

23 Claims, 4 Drawing Sheets

CLOSURE FOR BLOW MOLDED ARTICLES INCLUDING A SEPARATELY FORMED INSERT

BACKGROUND OF THE INVENTION

This invention is directed to preform and container closures, and more particularly, to a simplified closure having a shape and design devoid of finish moldings but including an insert portion.

The typical preform or container closure is formed from one piece and has an inner wall including a finish which generally includes threads. Accordingly, the typical closures include typical thread moldings which, in order to mold, require a low production speed to allow for delays in stripping and unscrewing the closure from a core that forms the internal thread. In addition, molding threaded closures requires high pressure and longer in-mold cooling because such a molded wall has a thicker width than a wall without the threads. Closures without the inside threaded surfaces could be molded at lower packing pressure and with simpler welds and machines, since the operation of molding threaded closures requires either unscrewing the molded part from a core or forced stripping therefrom.

The present closures are made as one piece, at times with a liner to improve the permeation resistance of the closure. Thus, the thread and the rest of the body are made of the same material which lacks the ability to create a seal. It would be preferable to have the thread act as a seal but since the material of the threaded body are the same, the thread cannot provide this function.

In addition to the features noted above, in the closure art, closures must often indicate whether the container has been tampered with before being used as intended. In conventional closures, evidence of tampering is provided by means that add substantially to the cost of production of the closure, and at times limits the choice of materials. Such is not the case with the closure of the present invention.

There exists a need, therefore, for a closure design having a simplified body structure, that is, with no inner thread rendering the stripping action difficult. There is also the important need to make the thread into a much better sealing element than it is now as well as a need for an improved means for closure tampering indication.

Referring to FIG. 7, cap 2 of the classic Mason jar 1 shown attempts to accomplish these same aims by separating the sealing and structural functions. Thus, the cap comprises a sealing plate i.e., a metal disc 3 with an elastomeric seal 4 at its periphery, held in place by a separate annular cap 2, threaded as shown, also made of metal. Accordingly, the attachment means are separate from the means to seal the container, but the design fails to use the threads as a sealing element.

SUMMARY OF THE INVENTION

The primary object of this invention is to provide a simplified closure which includes a body portion lacking an internal thread, to which a separately prepared threaded portion is assembled to complete the closure, whereby the two portions may be made of different materials.

Another object of this invention is to provide a simplified closure wherein a body portion thereof includes only a side wall and a top wall and an inside thread of the closure is provided via a separately molded and more easily formed portion in the form of a threaded insert used in combination with the body portion.

Yet another object of this invention is to provide a simplified closure having a container tampering indicator which does not substantially add to production costs of the closure or limit the choices of materials.

Still another object of this invention is to provide a process for forming a closure wherein the closure is formed from two separate components, one component providing the body portion of the closure and the other component providing inner threads of the closure.

And still another object of this invention is to provide a container using a closure wherein the closure includes two separately formed portions, one portion providing a closure body and the other portion providing a closure inner thread which also provides a seal.

The objects and advantages of the present invention set forth herein are achieved by a closure formed according to the principles of the present invention, which closure comprises a body portion having an open end, a closed end, an inner wall and an outer surrounding or circumferential wall; and an insert means for engaging a container, wherein the insert means is formed separately from the body portion and includes means for attachment to the body portion. The insert means is attached to the body portion adjacent the inner wall via the means for attachment.

A process for forming a closure in accordance with the principles of the present invention comprises the steps of forming a body portion having an open end and a closed end; forming separately from the body portion a means for engaging a container, the means for engaging including means for attachment to the body portion; and attaching the means for engaging to the body portion via the means for attachment.

A container using a closure in accordance with the principles of the present invention comprises a cavity forming portion including a base, a body continuous with the base, a shoulder continuous with the body, and an open end continuous with the shoulder; a closure including a body portion and an insert means for engaging the open end, wherein the insert means formed separately from the body portion, and wherein the insert means is positioned in the body portion for engaging the open end.

An insert for use with a cap or body component of a closure for sealing a container in accordance with the principles of the invention comprises means for attachment to the body component and means for engaging the container, wherein the insert is formed separately from the body component.

The details of the present invention are set out in the following description and drawings wherein like reference characters depict like elements.

DETAILED DESCRIPTION OF THE PREFERRED EMBODIMENT

Figure 1:
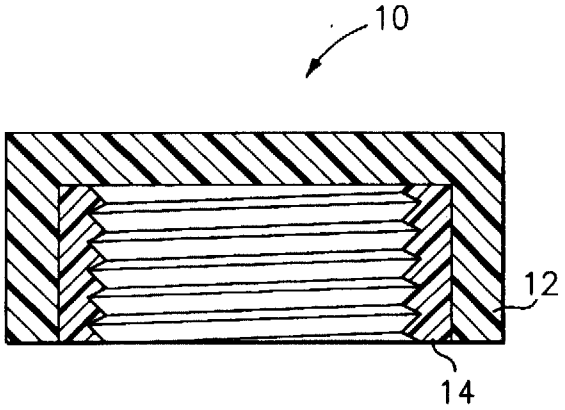
FIG. 1 is a cross-sectional elevational view of a closure in accordance with the principles of the present invention including both components thereof.

Referring now to the drawings in detail, there is shown in FIG. 1 an elevational and cross-sectional view of a closure designed in accordance with the principles of the present invention, which is designated generally as 10. Closure 10 includes two components, a body 12 and a threaded insert 14. As shown in FIG. 1, insert 14 is adapted to internally engage body 12.

Figure 2:
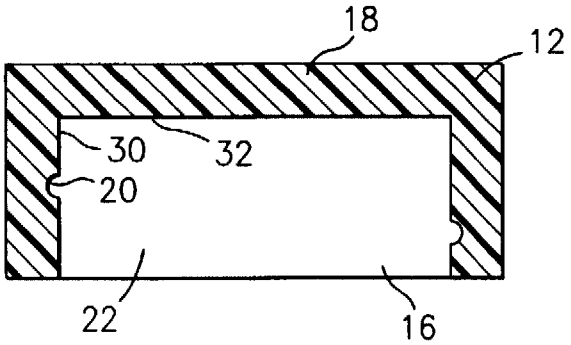
FIG. 2 is a cross-sectional elevational view of a first component of the closure of the present invention.
Figure 4B:
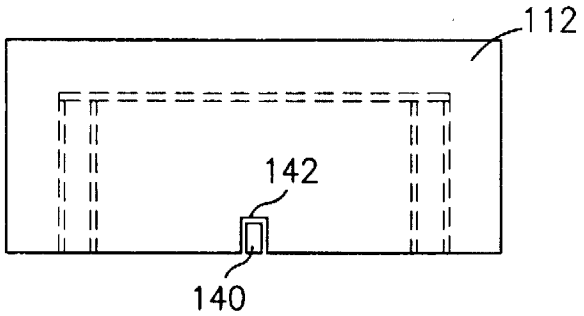
FIG. 4B is an elevational view of the closure shown in FIGS. 4 and 4A taken along line 4B—4B of FIG. 4A.
Figure 5:
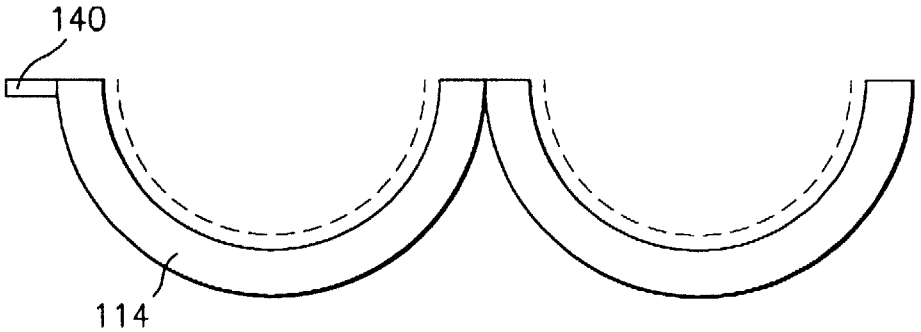
FIG. 5 is an overhead view of the closure of FIG. 4 shown in the open configuration in which it is formed.
Figure 4:
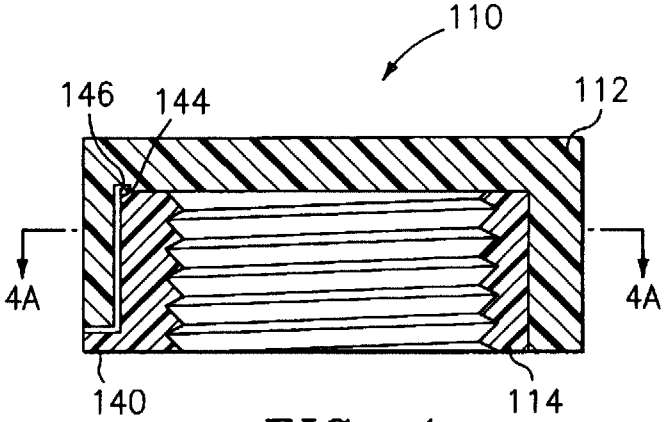
FIG. 4 is an elevational and partially cross-sectional view of a second embodiment of a closure in accordance with the principles of the present invention.
Figure 4A:
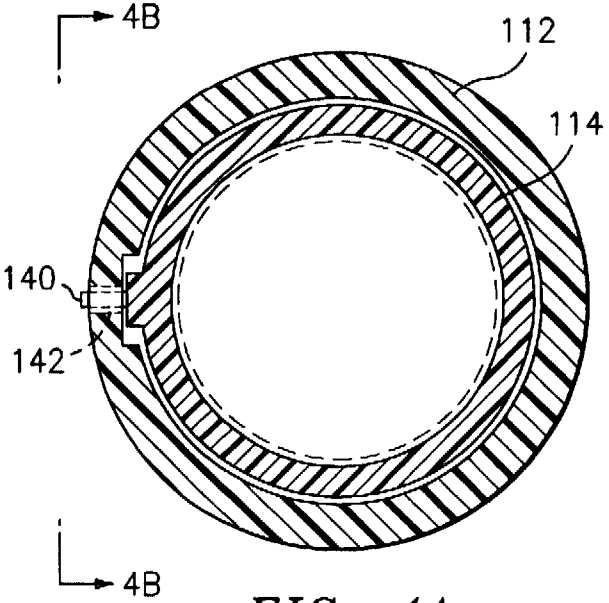
FIG. 4A is a cross-sectional view of the closure shown in FIG. 4 taken along line 4A—4A of FIG. 4.

Referring now to FIG. 2, body 12 of closure 10 is preferably cap-like in shape having an open end 16 and a closed end 18. Accordingly, body 12 is preferably cylindrical in shape up to closed end 18, having an outer circumferential wall and an inner wall 30 defining opening 22, wherein the inner wall engages insert 14 to secure or attach the same in position. Preferably, body 12 includes mechanical structure 20, such as detents, or adhesive, on the inner wall 30 thereof for facilitating securement or attachment with insert 14, as discussed below. As can be seen from the figures, body 12 does not include threads or other means for engaging a container thread. Therefore, body 12 can be more conveniently formed by injection molding or the like, since without threads to be molded and accordingly engaged by a core, core stripping mechanisms are not necessary.

Figure 3A:
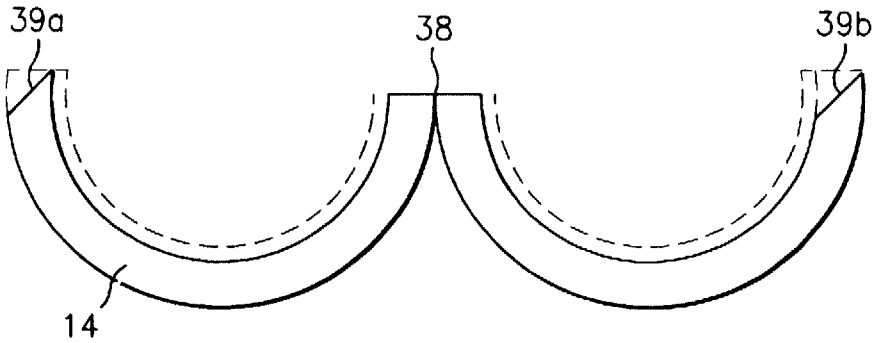
FIG. 3A shows a top view of a second component of the closure of the present invention in an open configuration in which it is formed.
Figure 3B:
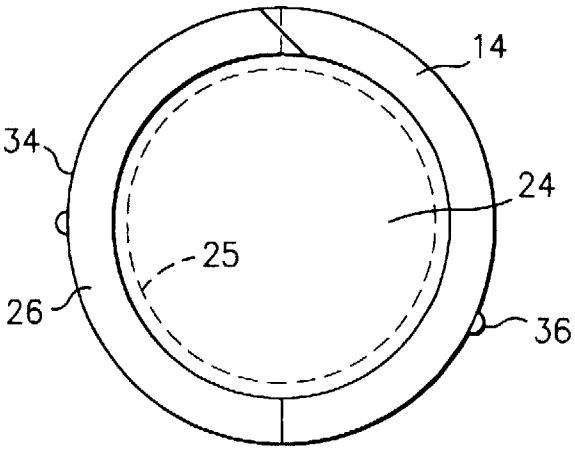
FIG. 3B is a top view of the second component shown in FIG. 3A in a closed functional configuration.

Referring now to FIGS. 3A and 3B, top views of open and closed configurations, respectively, of insert 14 are shown. Insert 14 preferably has a split annular shape, although other shapes such as segmented or unitary may be used, with hole 24 in the center thereof including a threaded inner surface 25, shown by dotted lines, for engagement with a set of threads of a container, shown in FIG. 6. As an alternative manner of engagement, a cam surface can be used. Insert 14 includes a circumferential wall 26. The surface 34 of wall 26 preferably has a plurality of serrations or protrusions 36, shown in FIG. 3B, therein or thereon for engagement with serrations or detents 20 in inner wall 30 of body 12, as shown in FIG. 2, forming mating and interlocking surfaces. Accordingly, when insert 14 is properly positioned, it is pressed adjacent to and into abutment with inner wall 30 such that structure 36 of wall 26 engage structure 20 on inner wall 30 of body 12. Engagement of these structures prevents rotation of insert 14 relative to body portion 12. Other means of securing the insert into position may be used, as known in the art. For example, a pressure or interference fit may be formed between walls 26 and 30, or an adhesive may be provided at the interface of wall 26 and wall 30, see FIG. 1.

For tamper indication, and referring to closure 110 shown in the embodiment of FIGS. 4, 4A, 4B and 5, the insert 114, molded as above, and shown herein perspectively, may be provided with a tab 140, and the cap with a corresponding opening 142 to accommodate tab 140, into which the tab may be inserted during assembly. To shear off the tab, body portion 112 and insert 114 must be rotated relative to each other. In this embodiment, relative rotation to a predetermined limited extent between body portion 112 and insert 114, while engaged with a container, is allowed. Joining between the insert and body portion is preferably accomplished mechanically, preferably by a spline 144 in one component and a corresponding groove 146 in the other component. The groove is preferably wider than the spline 144, so that upon first rotation of body portion 112, insert 114 will not "catch" the groove, relative movement will occur, and the tab 140 will break from movement against a stopping wall defining opening 142 to show tampering. Of course, other means of this nature may be used as tampering indicators.

In forming, body 12 is injection or otherwise molded from a plastic material, such as a low melt index polyolefin. As discussed, body 12 is formed as above, devoid of threads. Accordingly, during molding the use of core stripper mechanisms is avoided, thereby allowing for lower molding pressure to be used as well as a less space consuming platen, as discussed above.

Further, insert 14 is formed separately from body portion 12, preferably by a pressure molding process that is more efficient than that used for body portion 12. For example, insert 14 may be thermoformed or preferably embossed in an open position, or in two halves as shown in FIG. 3A. It may be made from the same material as body 12, but may also be made advantageously from other materials. Thus, an elastomeric sealing polymer may be used to effect a seal, in addition to merely holding a closure in place on a container. Insert 14 is molded with an outer wall 26 of a size for fitting in opening 22 of body 12. Protrusions or serrations 36 on wall 26 of insert 14 are preferably aligned with mating detents or serrations 20 on inner wall 30 of body 12, forming interlocking surfaces, so as to prevent insert 14 from rotating relative body 12 due to torsional forces acting thereon, such as during attachment of the closure to a container and during opening of the container. The protrusions or serrations may alternately be placed at any other interface of insert 14 and body 12, e.g., top wall 32 of body 12. As alternatives, body portion 12 and insert 14 may be press fit together to prevent relative motion therebetween, or an adhesive bond may be provided therebetween. With insert 14 securely positioned in body 12 closure 10 is completed.

As above described, insert 14 is preferably formed from a split annular ring with threads on its inner surface. It may be pressure molded in that shape, however, a mold for that purpose must have many mold impressions to be economically feasible. In a multiple array, such a mold is expensive because its thread forming elements require operating means which take up a great amount of space in the mold. For greater economy, the ring, i.e., insert 14, is preferably molded in the open or split configuration, as shown in FIG. 3A. Accordingly, two semi-circular portions are molded, with their concave faces carrying corresponding portions of thread for engaging container neck threads.

In use, the two semi-circles are closed into a ring, i.e., insert 14, as shown in FIG. 3B, before the same is applied in body 12 of closure 10. To facilitate closing the ring, hinge 38 may be provided, as shown in FIG. 3A. The surfaces **39*a* and 39*b*** along which the semi-circles are joined may be parallel to the ring axis as shown by the dotted lines in FIG. 3A, or angled, as shown by the solid lines in FIG. 3A, to provide a larger matching area that is self aligning to improve the sealing properties of the ring. It is readily seen that the mold in which the joined semi-circles are used is much simpler than the one for a ring, in that the thread forming part does not have to be separately movable. Also, the shape lends itself to more economical methods than injection molding, e.g., compression molding, thermoforming and embossing. The two semi-circles may of course also be separately molded and subsequently assembled into the ring shape.

The method for forming closure 10 is very productive and requires modest investment for extraordinary output. An extruder for sheet-stock feeds directly into a thermoformer, which may be linear, or rotary with mold cavities mounted on the face of a drum, as is well known. From the thermoformer, a sheet with formed inserts is advanced to a trimmer, where the inserts are separated and transferred into a closing device, to form the closed, finished inserts. Closing may be performed one-at-a-time, or by rows of tube-like structures, which are subsequently subdivided into individual inserts. All of these operations are conventional, and therefore not described in detail.

Figure 6:
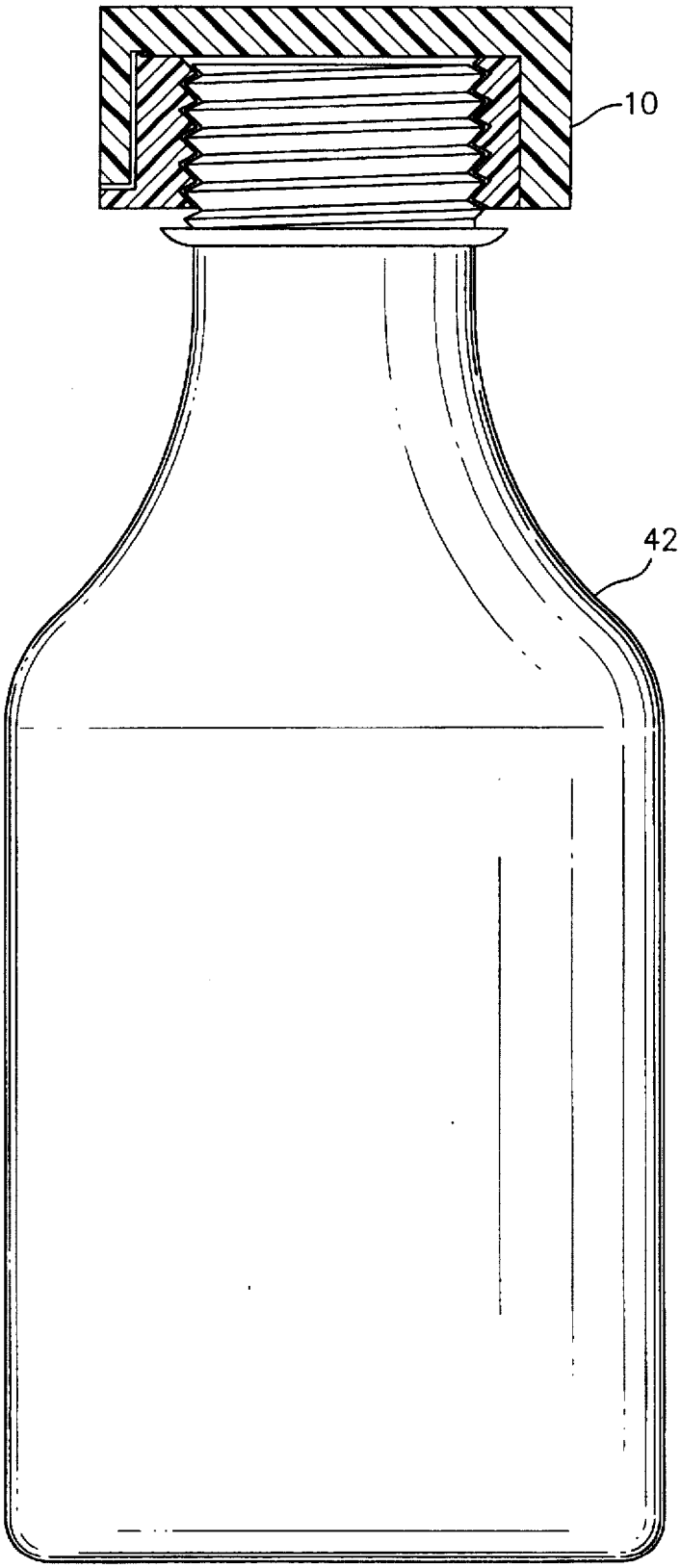
FIG. 6 is an elevational cross-sectional view of the closure of the present invention on a container.
Figure 7:
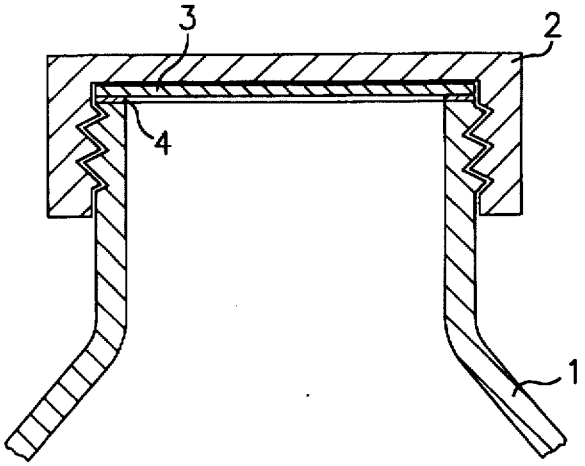
FIG. 7 (PRIOR ART)
FIG. 7 is an elevational and partial cross-sectional view of a closure of the prior art on a container.

In forming a container 42 using closure 10, shown as a bottle in the example of FIG. 6, a preform (not shown) is placed into a blow mold or the like and a finished container as shown in FIG. 6 is molded. Container 42 is formed by conventional expansion of the preform in a mold having a cavity corresponding to the desired shape of container 42. Accordingly, the container includes a cavity forming portion including a base of any convenient or desired configuration for support, a body continuous with the base, a shoulder continuous with the body, and an open end, termed a neck in the case of bottles, continuous with the shoulder. Closure 10 is engagable, as described above, with threads of the open neck, as shown. Closure 10 is formed as described above, having an internal thread for engagement with the container thread.

The primary advantage of this invention is that a simplified closure is provided which includes a body portion lacking an internal thread, to which a separately prepared threaded portion is assembled to complete the closure. Another advantage of this invention is that the body portion may be made of a material that provides structural integrity of the closure, while the threaded portion, i.e., the portion provided with means to attach the closure to the container, may be made of a material having better sealing characteristics than the material of the body portion. Another advantage of this invention is that a simplified closure is provided wherein a body portion thereof includes only a side wall and a top wall and an inside thread the closure is provided via a separately molded and more easily formed portion in the form of a threaded insert used in combination with the preform body portion. Yet another advantage of this invention is that a simplified closure having a container tampering indicator which does not substantially add to production costs of the closure or limit the choices of materials. Still another advantage of this invention is that a process is provided for forming two separate precursor components, one component providing a body portion and the other component providing a finish having closure engaging surfaces. And still another advantage of this invention is that a container is provided with a closure, wherein the closure includes two separately formed portions, one portion providing a closure body and the other portion providing a closure attachment means, such as an inner thread.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A closure, comprising:

an outer plastic element comprising a body portion having an open end, a closed top end and an inner wall and an outer surrounding wall;

an inner plastic element comprising an insert for engaging a container, said insert formed separately from said body portion and including means for attachment to said body portion, wherein said closed top end encompasses said insert, said insert attached to said body portion adjacent said inner wall via said means for attachment and including means to indicate tampering, wherein said means for indicating tampering comprises said insert having a tab and said body portion having a slot with a wall for engaging said tab, wherein said tab is observable from outside of the body portion, and wherein upon a given amount of rotation of said body portion relative said insert, said tab engages said wall of said slot and shears off said insert thereby indicating tampering;

means for stopping movement of said insert relative said body portion; and wherein said insert includes an inner surface including means for engaging said container comprising one of a thread and a cam for engaging a portion of said container.

2. The closure according to claim 1, wherein said stopping means allows limited movement up to a predetermined extent.

3. The closure according to claim 1, wherein said means for stopping movement is comprised of matching surfaces provided on each of said body portion and said insert, said matching surfaces engageable for preventing relative movement.

4. The closure according to claim 3, wherein said matching surfaces include surfaces extending from said insert and receiving means in said body portion for receiving said surfaces extending from said insert.

5. The closure according to claim 4, wherein said matching surfaces comprise a spline extending from said insert and a slot in said body portion for receiving said spline.

6. The closure according to claim 5, wherein said slot has a width greater than the thickness of said spline, said width defined by walls of said slot, and wherein said body portion is rotatable relative to said insert until one of said walls is engaged via said spline for stopping rotation.

7. The closure according to claim 1, wherein said body portion and said means for attachment are dimensioned to cause an interference fit between said insert and said body portion.

8. The closure according to claim 1, wherein said insert is an elastomer which creates a seal with said container.

9. The closure according to claim 1, wherein said insert comprises two connected halves, said halves having an open and a closed configuration, wherein said halves are molded in said open configuration and form said insert in said closed configuration.

10. The closure according to claim 9, wherein each of said halves are semi-circular in shape and include container engaging surfaces, said halves connected by at least one of mating surfaces and a hinge.

11. The closure according to claim 10, wherein said container engaging surfaces comprise inner surfaces of said halves.

12. A container closure assembly, comprising:

a hollow container having a closed cavity forming portion and an open neck portion;

a closure including, an outer plastic element comprising a body portion having an open end, a closed top end and an inner wall and an outer surrounding wall, an inner plastic element comprising an insert for engaging said neck portion, said insert formed separately from said body portion and including means for attachment to said body portion, wherein said closed top end encompasses said insert, said insert attached to said body portion adjacent said inner wall via said means for attachment and including means to indicate tampering, wherein said means for indicating tampering comprises said insert having a tab and said body portion having a slot with a wall for engaging said tab, wherein said tab is observable from outside of the body portion, and wherein upon a given amount of rotation of said body portion relative said insert, said tab engages said wall of said slot and shears off said insert thereby indicating tampering, means for stopping movement of said insert relative said body portion, wherein said insert includes an inner surface including means for engaging said neck portion comprising one of a thread and a cam, and wherein said insert is positioned in said body portion for engaging said open neck.

13. The container closure assembly according to claim 12, wherein said open neck includes insert engaging means for engaging said insert.

14. The container closure assembly according to claim 13, wherein said insert includes an inner thread and said insert engaging means includes an outer thread, wherein said outer and inner threads are mating threads for attaching said closure to open neck.

15. The container closure assembly according to claim 12, wherein said insert is formed from an elastomeric material which creates a seal with said container.

16. The container closure assembly according to claim 12, wherein said insert comprises two connected halves, said halves having an open and a closed configuration, wherein said halves are molded in said open configuration and form said insert in said closed configuration.

17. The container closure assembly according to claim 16, wherein each of said halves are semi-circular in shape and said insert comprises each of said halves having closure engaging surfaces, said halves connected by a hinge.

18. The container closure assembly according to claim 12, wherein said means for attachment includes a surface of said insert in contacting relationship with said neck portion.

19. The container closure assembly according to claim 18, wherein the surface in contacting relationship and the surface of the neck portion are interlocked by means of at least one of mechanical means and adhesive means.

20. The container closure assembly according to claim 18, wherein said means for engaging comprises an inner thread engagable with a mating thread of said container.

21. The container closure assembly according to claim 18, wherein said insert comprises two connected halves, said halves having an open and a closed configuration, wherein said halves are molded in said open configuration and form said insert in said closed configuration.

22. The container closure assembly according to claim 21, wherein each of said halves are semi-circular in shape and include said means for engaging, said halves connected by one of a hinge and mating surfaces.

23. The container closure assembly according to claim 21, wherein said means for engaging comprise inner surfaces of said halves.

* * * * *